US005545797A

United States Patent [19]

Ewing et al.

[11] Patent Number: 5,545,797

[45] Date of Patent: Aug. 13, 1996

[54] METHOD OF IMMOBILIZING WEAPONS PLUTONIUM TO PROVIDE A DURABLE, DISPOSABLE WASTE PRODUCT

[75] Inventors: Rodney C. Ewing; Werner Lutze, both of Albuquerque, N.M.; William J. Weber, Richland, Wash.

[73] Assignee: University of New Mexico, Albuquerque, N.M.

[21] Appl. No.: 372,204

[22] Filed: Jan. 13, 1995

[51] Int. Cl.[6] ..... G21F 9/00

[52] U.S. Cl. ..... 588/10; 588/14; 501/106; 501/152

[58] Field of Search ..... 588/14, 10; 264/0.5; 501/152, 106

[56] References Cited

U.S. PATENT DOCUMENTS 3,959,172 5/1976 Brownell et al. ..... 588/10

4,774,208 9/1988 Yamanaka et al. ..... 501/15

5,032,556 7/1991 Mori et al. ..... 801/106

OTHER PUBLICATIONS

Harker, A. B, et al "polyphase ceramic and glass–ceramic forms for immobilizing ICPP High level nuclear waste", Mater. Res. Soc. Symp. Proc., 1984, vol. 26, pp. 513–520.

"The radiation–induced crystalline . . . zircon"; William J. Weber, Robert C. Ewing and Lu–Min Wang; Mar. 1994; pp. 688–698.

*Primary Examiner*—Ngoclan Mai

*Attorney, Agent, or Firm*—Robert W. Becker

[57] ABSTRACT

A method of atomic scale fixation and immobilization of plutonium to provide a durable waste product. Plutonium is provided in the form of either $PuO_2$ or $Pu(NO_3)_4$ and is mixed with and $SiO_2$. The resulting mixture is cold pressed and then heated under pressure to form $(Zr,Pu)SiO_4$ as the waste product.

11 Claims, No Drawings

METHOD OF IMMOBILIZING WEAPONS PLUTONIUM TO PROVIDE A DURABLE, DISPOSABLE WASTE PRODUCT

The U.S. Government may have specific rights regarding this invention.

BACKGROUND OF THE INVENTION

The present invention relates to a method of immobilizing plutonium by atomic scale fixation in a crystalline ceramic in order to provide a durable, disposable waste form or product.

With the end of the cold war, it is now necessary to be able to dispose of large quantities of highly pure plutonium, especially plutonium recovered from nuclear weapons. Such plutonium is here referred to as weapons plutonium, indicating that it is not mixed with other nuclides. Heretofore known or proposed methods for the disposal of plutonium are not suitable for disposal of these large quantities of plutonium. In addition, plutonium is highly fissile, and it is necessary to develop extremely durable waste forms which reduce the possibility of mobilization and concentration of plutonium in quantities that can lead to criticality. The known borosilicate glass waste form is not very durable, attains saturation damage due to exposure to radiation in an unacceptably short period of time, and is readily altered, both by physical degradation and chemical alteration under conditions at which waste forms should be stable.

It is therefore an object of the present invention to provide a method that provides for the long-term disposal of plutonium in a waste form for which long-term durability can be confirmed and that overcomes the drawbacks of the heretofore known methods, with the inventive method providing a waste product or form that not only protects the environment but also ensures that the plutonium is not readily recoverable for use in weapons.

This object, and other objects and advantages of the present invention, will appear more clearly from the following specification and examples.

SUMMARY OF THE INVENTION

The object of the present invention is realized by a method of atomic scale fixation and immobilization of plutonium to provide a durable, disposable waste product and includes the steps of: providing plutonium in the form of $PuO_2$ or $Pu(NO_3)_4$, providing $ZrO_2$ and $SiO_2$, mixing these three compounds together to form a mixture, cold pressing the mixture to form pellets, blocks, or any desired shape, and heating the pellets, blocks, or other shaped forms under pressure to form the durable, disposable waste product.

As used in this application, the term immobilization indicates that the plutonium will not be able to migrate, and the term fixation is used to indicate that the plutonium is fixed at the atomic scale within the zircon structure.

The method of the present invention makes it possible to immobilize large amounts of plutonium in a single crystalline phase. In particular, the inventive method involves the chemical reaction, for example hot pressing or sol gel techniques, of $SiO_2$, $ZrO_2$ and desirable quantities of $PuO_2$ or $Pu(NO_3)_4$ (e.g. 10 mole % or more) to form a single phase of zircon doped with plutonium, in other words (Zr, Pu) $SiO_4$. It should be possible to incorporate this amount of plutonium in the zircon structure. However, if, for example, any of the $PuO_2$ fails to react and fails to become incorporated into the atomic structure of zircon, then the $PuO_2$ particles would be "encapsulated" in a matrix of zircon. This is still a highly stable and durable configuration for the waste form.

Effective disposal of plutonium requires incorporation into a solid matrix that is suitable for transportation, is resistant to radiation damage and is inert in most near surface environments. The zircon structure produced by the method of the present invention satisfies these requirements. It also avoids criticality. Since the half-life of Pu-239 is 24,000 years, and it is desirable to isolate materials for at least 10 half-lives, this amounts to 240,000 years. This is well within the range for which data are available on the geochemical behavior of natural zircons. In particular, studies have been done on natural zircons which may be up to billions of years old.

Thus, zircon is an extremely durable phase. In particular, its properties are known because zircon occurs naturally. For example, zircon is often found as a heavy mineral in stream sediments, and even after transport over great distances shows limited chemical alteration or physical degradation. The minor alteration that zircon undergoes over long periods of time and under extreme conditions makes it a far more desirable structure than the heretofore proposed glasses, which may more readily alter and degrade in relatively shorter periods of time. A 10 mole % substitution of plutonium for zirconium in the zircon structure has little effect on its chemical or physical properties. The study of the radiation effects of plutonium-doped zircon (8 mole %) and natural zircons (up to 4,000 ppm uranium) have shown that there is little difference in the radiation damage results (see *The Radiation-Induced Crystalline-To-Amorphous Transition In Zircon,* Weber, Ewing and Wang, Journal of Materials Research, Volume 9, Number 3, March 1994). Also, in distinct contrast to borosilicate glass, at temperatures below 80° C. and at a nearly neutral pH, in other words conditions that are pertinent to nuclear waste disposal, zircon is extremely insoluble, so that leaching does not lead to the release, migration or concentration of plutonium.

It should also be noted that the recovery of plutonium from the inventively produced zircon waste product is very difficult since the waste product is a highly refractory substance. With respect to criticality, concern thereof can be mitigated by adjusting the waste loading of plutonium in the zircon structure, and also by incorporating neutron absorbing nuclides, such as gadolinium, into the zircon structure. Natural zircons contain small quantities of gadolinium, which is an effective neutron poison.

U.S. Pat. 3,959,172, Brownell et al, discloses the immobilization of radionuclides by a gel process or by a hydrothermal slurrying process. Unfortunately, such processes are not suitable for the large-scale provision of a durable, disposable waste product, and this reference certainly does not indicate how to make a (Zr, Pu)$SiO_4$ single phase waste form.

The following are examples showing the processing of $Zr_{1-x}Pu_xSiO_4$ as a waste form for weapons plutonium, with the following Example 1 being intended merely to prove synthesis in the laboratory and not being pursuant to the present inventive method, whereas the actual production of a zircon structure waste product made by the inventive method for fixating or immobilizing plutonium is discussed in Example 2.

The main goal of all processing techniques, in the laboratory or at large scale, is to achieve an intimate mixture of the reacting constituents in order to obtain maximum waste form performance (high chemical durability). The Pu concentration "x" can range from $0<x<1$. The waste form can be produced in glove boxes. Handling techniques of large amounts of $PuO_2$ powder are well established and used to produce $UO_2$-$PuO_2$ (MOX) fuel for nuclear power reactors. Y-radiation emitters can be incorporated in the waste form to limit accessibility. In this case, part of the processing equipment must be shielded.

EXAMPLE 1

Preparation of $Zr_{1-x}Pu_xSiO_4$ in the Laboratory

Dissolve Pu in hydrochloric acid (HCl) and add nitric acid ($HNO_3$. Evaporate off HCl at about 100° C. Add more $HNO_3$ and evaporate again (if necessary, repeat to dissolve Pu completely). Add $HNO_3$ and dilute with water to form an aqueous Pu-nitrate solution.

Mix stoichiometric quantities of the Pu-nitrate solution, zirconium nitrate [$Zr(NO_3)_4 \cdot yH_2O$] and tetraethylorthosilicate (TEOS) in ethyl alcohol and water to achieve the desired loading of Pu (x-value). Add gadolinium nitrate [$Gd(NO_3)_2 \cdot yH_2O$] solution in a small quantity, if a neutron poison is necessary for criticality control. Gd will partially substitute for Pu or Zr. At this stage, a Y-radiation emitter, e.g., Co-60, can also be added in small quantities, if easy physical access to the final waste form is to be prevented.

Heat this solution to 40° to 50° C. for several days to allow nucleation to occur. Add ammonium hydroxide ($NH_4OH$) to form a precipitate. Remove the precipitate and dry at about 90° to 100° C. Calcine the dried precipitate at about 800° C. to remove residual water and to decompose nitrate.

The powder can be processed into a final waste form by cold pressing and subsequent sintering at about 1800° C. to produce a high density, impervious, and chemically durable solid that can be placed in a metal canister for transportation, storage, and final disposal in a geologic repository.

Alternatively, a metal-sheathed high-density waste form can be obtained by uniaxially cold pre-pressing and subsequently hot pressing the powder in a metal bellows container at temperatures from 1150° to 1350° C. These bellows can then be placed in metal containers for transportation, storage, and disposal.

EXAMPLE 2

Preparation of $Zr_{1-x}Pu_xSiO_4$ at a Larger Scale

For obvious reasons, this process has not yet been tested but is envisaged to be conducted as follows:

Convert Pu metal to Pu-nitrate as in Example 1 and dry the nitrate at 90° to 100° C., or convert Pu metal to Pu-oxide by oxidation in air or in oxygen. The rate of oxidation can be controlled by the amount of oxygen or air in the reaction cell.

Mix stoichiometric quantities of Pu-oxide with Zr-oxide ($ZrO_2$) and silicon oxide ($SiO_2$) powders to achieve desired waste loading. Add neutron poison as an oxide ($Gd_2O_3$) powder, if desirable. If Pu is added as nitrate, calcine the mixture at 650° C. to remove water and decompose nitrate. Intimate mixing of the powders, e.g. in a screw blender, is necessary to facilitate the solid state reaction and to keep the reaction temperatures and pressures as low as possible. If necessary, $ZrO_2$ and $SiO_2$ powders could be obtained by hydrolysis of mixtures of respective organic precursors (e.g., TEOS or TMOS for $SiO_2$). Amorphous silica or other reactive products such as xerogels can also be used.

After mixing, the powder can be processed as described above. The powder must be transferred into a bellows feeder from where it can be vibrated into the bellows. Prior to cold pressing a small quantity of zircon ($ZrSiO_4$) doped with a Y-emitter, or the Y-emitter as such, could be added, if desirable. The Y-doped zircon need not be distributed homogeneously and can be introduced into the feeder or into the bellows. Hence, only the steps of bellows filling and cold and hot pressing are conducted in a shielded environment. The exact conditions of the hot pressing step (temperature, pressure and time) of large scale processing of the waste form, starting with oxide mixtures, depend on the details of the process. Approximate values should be as follows: Temperatures 1150° to 1350° C., pressure 15–30 MPa, time 1 to 2 hours.

It should be noted that the cold pressing and the heating are carried out in the same bellows. The bellows are first cold pressed to increase the thermal conductivity of the powder, whereupon heating is effected. This will decrease the reaction time at temperature and under pressure.

From the foregoing, it can be seen that the inventive method offers a number of advantages over the heretofore known methods. For example, due to the relatively high waste loading that is possible as well as the smaller volume that is achieved, deep, permanent disposal of plutonium in geologic environments where a borosilicate waste form glass would not be stable is possible. Furthermore, due to the high durability of the zircon structure, disposal in an open system in which ground water is present is also possible. The reason that zircon is an improvement over glass for deep disposal is threefold. First of all, zircon is stable at higher temperatures, and deep disposal brings glass into a temperature range in which it is not stable due to the geothermal gradient. Secondly, a higher waste loading in zircon is possible, and this reduces the volume of material that must be placed down a drill hole. Higher waste loading is possible pursuant to the present invention because zircon is durable at high temperatures and the low release rate due to chemical corrosion means that the probability of release, concentration, and ultimately criticality is minimized. Thirdly, methods of criticality control of $PuO_2$ are well-known from mixed-oxide full (MOX) fabrication and can be applied to the fabrication of zircon.

In summary, due to the extremely durable phase of the zircon structure the latter can be used as a plutonium host for the disposal of large quantities of plutonium. This long-term durability of the zircon structure has been confirmed from natural occurrences in diverse and extreme geologic environments over extremely long periods of time. The very low solubility of the zircon structure ensures that plutonium will not be concentrated by later cycles of geochemical alteration to values that might lead to criticality. Finally, the lower volume provided by the inventively produced waste product, and the greater durability, particularly at elevated temperatures, expands the range of possible geologic disposal sites.

The present invention is, of course, in no way restricted to the specific disclosure of the specification and examples, but also encompasses any modifications within the scope of the appended claims.

What we claim is:

1. A method of atomic scale fixation and immobilization of plutonium to provide a durable, disposable waste product, said method including the steps of:

providing plutonium in the form of one of the group consisting of $PuO_2$ and $Pu(NO_3)_4$;

providing $ZrO_2$ and $SiO_2$;

mixing said $PuO_2$ or $Pu(NO_3)_4$, $ZrO_2$ and $SiO_2$ together to form a mixture;

cold pressing said mixture to form a pressed product; and heating said pressed product under pressure to form said durable, disposable waste product in the form of $(Zr, Pu)SiO_4$.

2. A method according to claim 1, wherein said step of providing plutonium comprises converting plutonium metal to $Pu(NO_3)_4$ in dry form.

3. A method according to claim 1, wherein said step of providing plutonium comprises converting plutonium metal to $PuO_2$ by oxidation thereof.

4. A method according to claim 1, wherein said mixing step includes adding a neutron poison in the form of $Gd_2O_3$ powder.

5. A method according to claim 1, wherein said mixing step includes adding one of the group consisting of a Y-emitter, and powdered $ZrSiO_4$ doped with a Y-emitter.

6. A method according to claim 3, wherein said heating step comprises sintering said pressed product at 1150°–1350° C. for 1 to 2 hours at 15–30 MPa.

7. A method according to claim 2, wherein said heating step comprises sintering said pressed product at about 1800° C.

8. A method according to claim 2, which includes the step, prior to said cold pressing step, of calcining said mixture at about 650° C.

9. A method according to claim 1, wherein said mixing step comprises intimately mixing said constituents in a screw blender.

10. A method according to claim 1, wherein said step of cold pressing said mixture comprises pressing said mixture in a bellows.

11. A method according to claim 10, wherein said heating step comprises heating said pressed product under pressure in said bellows.

* * * * *